US008639519B2

(12) United States Patent
Ashley et al.

(10) Patent No.: US 8,639,519 B2
(45) Date of Patent: Jan. 28, 2014

(54) METHOD AND APPARATUS FOR SELECTIVE SIGNAL CODING BASED ON CORE ENCODER PERFORMANCE

(75) Inventors: James P. Ashley, Naperville, IL (US); Jonathan A. Gibbs, Winchester (GB); Udar Mittal, Hoffman Estates, IL (US)

(73) Assignee: Motorola Mobility LLC, Libertyville, IL (US)

( * ) Notice: Subject to any disclaimer, the term of this patent is extended or adjusted under 35 U.S.C. 154(b) by 1178 days.

(21) Appl. No.: 12/099,842

(22) Filed: Apr. 9, 2008

(65) Prior Publication Data

US 2009/0259477 A1 Oct. 15, 2009

(51) Int. Cl.
*G10L 19/00* (2013.01)

(52) U.S. Cl.
USPC ..... 704/500; 704/501; 704/503; 704/504; 704/E21.002; 704/E11.003

(58) Field of Classification Search
USPC ..... 704/500
See application file for complete search history.

(56) References Cited

U.S. PATENT DOCUMENTS

| | | | | |
|---|---|---|---|---|
| 4,560,977 | A | 12/1985 | Murakami et al. | |
| 4,670,851 | A | 6/1987 | Murakami et al. | |
| 4,727,354 | A | 2/1988 | Lindsay | |
| 4,853,778 | A | 8/1989 | Tanaka | |
| 5,006,929 | A | 4/1991 | Barbero et al. | |
| 5,067,152 | A | 11/1991 | Kisor et al. | |
| 5,327,521 | A | 7/1994 | Savic et al. | |
| 5,394,473 | A | 2/1995 | Davidson | |
| 5,956,674 | A | 9/1999 | Smyth et al. | |
| 6,108,626 | A * | 8/2000 | Cellario et al. | 704/230 |
| 6,236,960 | B1 | 5/2001 | Peng et al. | |
| 6,253,185 | B1 | 6/2001 | Arean et al. | |
| 6,263,312 | B1 | 7/2001 | Kolesnik et al. | |
| 6,304,196 | B1 | 10/2001 | Copeland et al. | |
| 6,453,287 | B1 | 9/2002 | Unno et al. | |
| 6,493,664 | B1 | 12/2002 | Udaya Bhaskar et al. | |
| 6,504,877 | B1 | 1/2003 | Lee | |
| 6,593,872 | B2 | 7/2003 | Makino et al. | |
| 6,658,383 | B2 | 12/2003 | Koishida et al. | |
| 6,662,154 | B2 | 12/2003 | Mittal et al. | |

(Continued)

FOREIGN PATENT DOCUMENTS

| | | |
|---|---|---|
| EP | 0932141 A2 | 7/1999 |
| EP | 1483759 | 8/2004 |

(Continued)

OTHER PUBLICATIONS

Ramo et al. "Quality Evaluation of the G.EV-VBR Speech Codec" Apr. 4, 2008.*

(Continued)

*Primary Examiner* — Greg Borsetti

(57) ABSTRACT

In a selective signal encoder, an input signal is first encoded using a core layer encoder to produce a core layer encoded signal. The core layer encoded signal is decoded to produce a reconstructed signal and an error signal is generated as the difference between the reconstructed signal and the input signal. The reconstructed signal is compared to the input signal. One of two or more enhancement layer encoders selected dependent upon the comparison and used to encode the error signal. The core layer encoded signal, the enhancement layer encoded signal and the selection indicator are output to the channel (for transmission or storage, for example).

15 Claims, 6 Drawing Sheets

(56) References Cited

U.S. PATENT DOCUMENTS

| | | | | |
|---|---|---|---|---|
| 6,691,092 | B1 | 2/2004 | Udaya Bhaskar et al. | |
| 6,704,705 | B1 | 3/2004 | Kabal et al. | |
| 6,775,654 | B1 | 8/2004 | Yokoyama et al. | |
| 6,813,602 | B2 | 11/2004 | Thyssen | |
| 6,940,431 | B2 | 9/2005 | Hayami | |
| 6,975,253 | B1 | 12/2005 | Dominic | |
| 7,031,493 | B2 | 4/2006 | Fletcher et al. | |
| 7,130,796 | B2 | 10/2006 | Tasaki | |
| 7,161,507 | B2 | 1/2007 | Tomic | |
| 7,180,796 | B2 | 2/2007 | Tanzawa et al. | |
| 7,212,973 | B2 | 5/2007 | Toyama et al. | |
| 7,230,550 | B1 | 6/2007 | Mittal et al. | |
| 7,231,091 | B2 | 6/2007 | Keith | |
| 7,414,549 | B1 | 8/2008 | Yang et al. | |
| 7,461,106 | B2 | 12/2008 | Mittal et al. | |
| 7,596,486 | B2 | 9/2009 | Ojala et al. | |
| 7,761,290 | B2 | 7/2010 | Koishida et al. | |
| 7,801,732 | B2 * | 9/2010 | Park et al. | 704/500 |
| 7,840,411 | B2 * | 11/2010 | Hotho et al. | 704/500 |
| 7,885,819 | B2 | 2/2011 | Koishida et al. | |
| 7,996,233 | B2 * | 8/2011 | Oshikiri | 704/500 |
| 8,015,017 | B2 * | 9/2011 | Sung et al. | 704/500 |
| 8,060,363 | B2 * | 11/2011 | Ramo et al. | 704/227 |
| 8,069,035 | B2 * | 11/2011 | Yoshida | 704/201 |
| 8,160,868 | B2 * | 4/2012 | Kawashima et al. | 704/206 |
| 8,195,454 | B2 | 6/2012 | Muesch | |
| 8,306,827 | B2 * | 11/2012 | Yamanashi et al. | 704/500 |
| 8,315,863 | B2 * | 11/2012 | Oshikiri | 704/228 |
| 2002/0052734 | A1 | 5/2002 | Unno et al. | |
| 2003/0004713 | A1 | 1/2003 | Makino et al. | |
| 2003/0009325 | A1 | 1/2003 | Kirchherr et al. | |
| 2003/0220783 | A1 * | 11/2003 | Streich et al. | 704/200.1 |
| 2004/0252768 | A1 | 12/2004 | Suzuki et al. | |
| 2005/0261893 | A1 | 11/2005 | Toyama et al. | |
| 2006/0022374 | A1 | 2/2006 | Chen et al. | |
| 2006/0047522 | A1 | 3/2006 | Ojanpera | |
| 2006/0173675 | A1 * | 8/2006 | Ojanpera | 704/203 |
| 2006/0190246 | A1 * | 8/2006 | Park | 704/221 |
| 2006/0241940 | A1 | 10/2006 | Ramprashad | |
| 2006/0265087 | A1 * | 11/2006 | Philippe et al. | 700/94 |
| 2007/0171944 | A1 * | 7/2007 | Schuijers et al. | 370/537 |
| 2007/0239294 | A1 | 10/2007 | Breuckner et al. | |
| 2007/0271102 | A1 * | 11/2007 | Morii | 704/268 |
| 2008/0065374 | A1 | 3/2008 | Mittal et al. | |
| 2008/0120096 | A1 * | 5/2008 | Oh et al. | 704/211 |
| 2009/0024398 | A1 | 1/2009 | Mittal et al. | |
| 2009/0030677 | A1 * | 1/2009 | Yoshida | 704/219 |
| 2009/0076829 | A1 | 3/2009 | Ragot et al. | |
| 2009/0083041 | A1 * | 3/2009 | Yoshida | 704/500 |
| 2009/0094024 | A1 * | 4/2009 | Yamanashi et al. | 704/219 |
| 2009/0100121 | A1 | 4/2009 | Mittal et al. | |
| 2009/0112607 | A1 | 4/2009 | Ashley et al. | |
| 2009/0231169 | A1 | 9/2009 | Mittal et al. | |
| 2009/0234642 | A1 | 9/2009 | Mittal et al. | |
| 2009/0276212 | A1 | 11/2009 | Khalil et al. | |
| 2009/0306992 | A1 * | 12/2009 | Ragot et al. | 704/500 |
| 2009/0326931 | A1 * | 12/2009 | Ragot et al. | 704/220 |
| 2010/0088090 | A1 | 4/2010 | Ramabadran | |
| 2010/0169087 | A1 | 7/2010 | Ashley et al. | |
| 2010/0169099 | A1 | 7/2010 | Ashley et al. | |
| 2010/0169100 | A1 | 7/2010 | Ashley et al. | |
| 2010/0169101 | A1 | 7/2010 | Ashley et al. | |
| 2011/0161087 | A1 | 6/2011 | Ashley et al. | |

FOREIGN PATENT DOCUMENTS

| | | | |
|---|---|---|---|
| EP | 1533789 | | 5/2005 |
| EP | 1619664 | | 1/2006 |
| EP | 1818911 | A1 | 8/2007 |
| EP | 1845519 | | 10/2007 |
| EP | 1912206 | A1 | 4/2008 |
| EP | 1959431 | A1 | 8/2008 |
| EP | 1959431 | B1 | 6/2010 |
| WO | 9715983 | | 5/1997 |
| WO | 03073741 | A2 | 9/2003 |
| WO | 2008063035 | A1 | 5/2008 |
| WO | 2010003663 | A1 | 1/2010 |

OTHER PUBLICATIONS

Jelinek et al. "Itu-T G.EV-VBR Baseline Codec" Apr. 4, 2008.*

Jelinek et al. "Classification-Based Techniques for Improving the Robustness of Celp Coders" 2007.*

Fuchs et al. "A Speech Coder Post-Processor Controlled by Side-Information" 2005.*

J. Fessle. "Chapter 2 Discrete-time signals and systems" 2004.*

Tancerel, L. et al., "Combined Speech and Audio Coding by Discrimination," In Proceedings of IEEE Workshop on Speech Coding, pp. 154-156, (2000).

Kyung Tae Kim et al.: "A new bandwidth scalable wideband speech/audio coder", 2002 IEEE International Conference on Acoustics, Speech, and Signal Processing Proceedings, (ICASSP), Orlando FL. May 13-17, 2002, [IEEE International Conference on Acoustics, Speech, and Signal Processing (ICASSP)], New York, NY, IEEE, US vol. 1, May 13, 2002, pp. 1-657.

Kovesi B et al.: "A scalable speech and audio coding scheme with continuous bitrate flexiblity", Acoustics, Speech, and Signal Processing, 2004, Proceedings, (ICASSP '04), IEEE International Conference on Montreal, Quebec, Canada May 17-21, 2004, Piscataway, NJ, USA, IEEE, Piscataway, NJ, USA, vol. 1, May 17, 2004, pp. 273-276.

Daniele Cadel, et al. "Pyramid Vector Coding for High Quality Audio Compression", IEEE 1997, pp. 343-346, Cefriel, Milano, Italy and Alcatel Telecom, Vimercate Italy.

"Enhanced Variable Rate Codec, Speech Service Options 3, 68 and 70 for Wideband Spread Spectrum Digital Systems", 3GPP2 TSG-C Working Group 2, XX, XX, No. C S0014-C, Jan. 1, 2007, pp. 1-5.

Virette et al "Adaptive Time-Frequency Resolution in Modulated Transform at Reduced Delay" ICASSP 2008; pp. 3781-3784.

Edler "Coding of Audio Signals with Overlapping Block Transform and Adaptive Window Functions"; Journal of Vibration and Low Voltage fnr; vol. 43, 1989, Section 3.1.

Ido Tal et al.: "On Row-by-Row Coding for 2-D Constraints", Information Theory, 2006 IEEE International Symposium on, IEEE, PI, Jul. 1, 2006, pp. 1204-1208.

Greiser, Norbert: "The International Search Report and The Written Opinion of the International Searching Authority", European Patent Office, Rijswijk, completed: Feb. 26, 2010, mailed Mar. 10, 2010, all pages.

Winkler, Gregor: "The International Search Report and the Written Opinion of the International Searching Authority", European Patent Office, Rijswijk, completed: Jul. 21, 2009, mailed Jul. 28, 2009, all pages.

Winkler, Gregor: "The International Search Report and The Written Opinion of the International Searching Authority", European Patent Office, Rijswijk, completed: Jul. 8, 2009, mailed: Jul. 20, 2009, all pages.

Chat C. Do: "The International Search Report and the Written Opinion of the International Searching Authority", US Patent Office, completed: May 22, 2008, mailed Jul. 23, 2008, all pages.

Zimmermann, Elko: "The International Search Report and The Written Opinion of the International Searching Authority", European Patent Office, Rijswijk, completed: Nov. 14, 2008, mailed: Dec. 15, 2008, all pages.

Greiser, Norbert: "The International Search Report and The Written Opinion of the International Searching Authority", European Patent Office, Rijswijk, completed Feb. 25, 2010, mailed: Mar. 5, 2010, all pages.

Greiser, Norbert: "The International Search Report and The Written Opinion of the International Searching Authority", European Patent Office, Rijswijk, completed: Mar. 2, 2010, mailed: Mar. 15, 2010, all pages.

Greiser, Norbert: "The International Search Report and the Written Opinion of the International Searching Authority", European Patent Office, Rijswijk, completed: Mar. 8, 2010, mailed: Mar. 15, 2010, all pages.

(56) References Cited

OTHER PUBLICATIONS

Ramprashad: "Embedded Coding Using a Mixed Speech and Audio Coding Paradigm" International Journal of Speech Technology Kluwer Academic Publishers Netherlands, Vo. 2, No. 4, May 1999, pp. 359-372.
Hung et al., Error-Resilient Pyramid Vector Quantization for Image Compression, IEEE Transactions on Image Processing, 1994 pp. 583-587.
Princen et al., "Subband/Transform Coding Using Filter Sank Designs Based on Time Domain Aliasing Cancellation" IEEE 1987; pp. 2181-2164.
Ramprashad, "High Quality Embedded Wideband Speech Coding Using an Inherently Layered Coding Paradigm," Proceedings of International Conference on Acoustics, Speech, and Signal Processing, ICASSP 2000, vol. 2, Jun. 5-9, 2000, pp. 1145-1148.
Ramprashad, "A Two Stage Hybrid Embedded Speech/Audio Coding Structure," Proceedings of Internationnal Conference on Acoustics, Speech, and Signal Processing, ICASSP 1998, May 1998, vol. 1, pp. 337-340, Seattle, Washington.
International Telecommunication Union, "G.729.1, Series G: Transmission Systems and Media, Digital Systems and Networks, Digital Terminal Equipments—Coding of analogue signals by methods other than PCM,G.729 based Embedded Variable bit-rate coder: An 8-32 kbit/s scalable wideband coder bitstream interoperable with G.729," ITU-T Recomendation G.729.1, May 2006, Cover page, pp. 11-18. Full document available at: http://www.itu.int/rec/T-REC-G.729.1-200605-l/en.
Mittal et al., Coding unconstrained FCB excitation using combinatorial and Huffman codes, Speech Coding 2002 IEEE Workshop Proceedings, Oct. 1, 2002, pp. 129-131.
Ashley et al., Wideband coding of speech using a scalable pulse codebook, Speech Coding 2000 IEEE Workshop Proceedings, Sep. 1, 2000, pp. 148-150.
Mittal et al., Low complexity factorial pulse coding of MDCT coefficients using approximation of combinatorial functions, Acoustics, Speech and Signal Processing, 2007. ICASSP 2007. IEEE International Conference on, Apr. 1, 2007, pp. I-289-I-292.
3rd Generation Partnership Project, Technical Specification Group Service and System Aspects;Audio codec processing functions;Extended Adaptive Multi-Rate—Wideband (AMR-WB+) codec; Transcoding functions (Release 7), V7.0.0, Mar. 1, 2007.
Chan et al., "Frequency domain postfiltering for multiband excited linear predictive coding of speech", In Electronics Letters, pp. 1061-1063, Feb. 27, 1996.
Chen et al., "Adaptive postfiltering for quality enhancement of coded speech", In IEEE Transactions on Speech and Audio Processing, vol. 3, No. 1, pp. 59-71, Jan. 1, 1995.
Andersen et al., "Reverse water-filling in predictive encoding of speech", In 1999 IEEE Workshop on Speech Coding Proceedings, pp. 105-107, Jun. 20, 1999.
Makinen et al., "AMR-WB+: a new audio coding standard for 3rd generation mobile audio service", In 2005 Proceedings IEEE International Conference on Acoustics, Speech and Signal Processing, vol. 2, pp. ii/1109-ii/1112, Mar. 18, 2005.
Faller et al., "Technical advances in digital audio radio broadcasting", Proceedings of the IEEE, vol. 90, No. 8, pp. 1303-1333, Aug. 1, 2002.
Salami et al., "Extended AMR-WB for High-Quality Audio on Mobile Devices", IEEE Communications Magazine, pp. 90-97, May 1, 2006.
Hung et al., Error-resilient pyramid vector quantization for image compression, IEEE Transactions on Image Processing, vol. 7, No. 10, Oct. 1, 1998.
Markas T. et al.: "Multispectral image compression algorithms", Data Compression Conference, 1993, DCC'93, Snowbird, UT, USA Mar. 30-Apr. 2, 1993, Los Alamitos, CA, USA, IEEE Compt. Soc. US, Mar. 30, 1993, pp. 391-400.
Boris Ya Ryabko et al.: "Fast and Efficient Construction of an Unbiased Random Sequence", IEEE Transactions on Information Theory, IEEE, US, vol. 46, No. 3, May 1, 2000, ISSN: 0018-9448, pp. 1090-1093.
Ratko V. Tomic: "Quantized Indexing: Background Information", May 16, 2006, URL: http://web.archive.org/web/20060516161324/www.1stworks.com/ref/TR/tr05-0625a.pdf, pp. 1-39.
Chinese Patent Office (SIPO), 1st Office Action for Chinese Patent Application No. 200980153318.0 dated Sep. 12, 2012, 6 pages.
United States Patent and Trademark Office, "Non-Final Office Action" for U.S. Appl. No. 12/844,199 dated Aug. 31, 2012, 13pages.
United States Patent and Trademark Office, "Non-Final Office Action" for U.S. Appl. No. 12/187,423 dated Sep. 30, 2011, 9 pages.
Mexican Patent Office, 2nd Office Action, Mexican Patent Application MX/a/2010/004479 dated Jan. 31, 2002, 5 pages.
United States Patent and Trademark Office, "Non-Final Office Action" for U.S. Appl. No. 12/345,165 dated Sep. 1, 2011, 5 pages.
United State Patent and Trademark Office, Non-Final Rejection for Patent U.S. Appl. No. 12/196,414 dated Jun. 4, 2012, 9 pages.
Ratko V. Tomic: "Fast, Optimal Entropy Coder" 1stWorks Corporation Technical Report TR04-0815, Aug. 15, 2004, pp. 1-52.
Patent Cooperation Treaty, "PCT Search Report and Written Opinion of the International Searching Authority" for International Application No. PCT/US2011/0266400 Aug. 5, 2011, 11 pages.
Neuendorf, et al., "Unified Speech Audio Coding Scheme for High Quality oat Low Bitrates" ieee International Conference on Accoustics, Speech and Signal Processing, 2009, Apr. 19, 2009, 4 pages.
Bruno Bessette: "Universal Speech/Audio Coding using Hybrid ACELP/TCX Techniques", Acoustics, Speech, and Signal Processing, 2005. Proceedings. (ICASSP '05). IEEE International Conference, Mar. 18-23, 2005, ISSN : III-301-III-304, Print ISBN: 0-78.
United States Patent and Trademark Office, "Non-Final Rejection" for U.S. Appl. No. 12/047,632 dated Mar. 2, 2011, 20 pages.
Patent Cooperation Treaty, "PCT Search Report and Written Opinion of the International Searching Authority" for International Application No. PCT/US2011/026660 Jun. 15, 2011, 10 pages.
Udar Mittal et al., Encoder for Audio Signal Including Generic Audio and Speech Frames, U.S. Appl. No. 12/844,199, filed Jul. 27, 2010.
Udar Mittal et al., "Decoder for Audio Signal Including Generic Audio and Speech Frames", U.S. Appl. No. 12/844,206, filed Sep. 9, 2010.
Office Action for U.S. Appl. No. 12/345,141, mailed Sep. 19, 2011.
Office Action for U.S. Appl. No. 12/345,165, mailed Sep. 1, 2011.
Office Action for U.S. Appl. No. 12/047,632, mailed Oct. 18, 2011.
Office Action for U.S. Appl. No. 12/187,423, mailed Sep. 30, 2011.
European Patent Office, Supplementary Search Report for EPC Patent Application No. 07813290.9 dated Jan. 4, 2013, 8 pages.
Cover, T.M., "Enumerative Source Encoding" IEEE Transactions on Information Theory, IEEE Press, USA vol. IT-19, No. 1; Jan. 1, 1973, pp. 73-77.
Mackay, D., "Information Theory, Inference, and Learning Algorithms" In: "Information Theory, Inference, and Learning Algorithms", Jan. 1, 2004; pp. 1-10.
Korean Intellectual Property Office, Notice of Preliminary Rejection for Korean Patent Application No. 10-2010-0725140 dated Jan. 4, 2013.
The Federal Service for Intellectual Property, Patents and Trade Marks (Rospatent), Decision on Grant, Aug. 12, 2013, all pages.

* cited by examiner

METHOD AND APPARATUS FOR SELECTIVE SIGNAL CODING BASED ON CORE ENCODER PERFORMANCE

BACKGROUND

Transmission of text, images, voice and speech signals across communication channels, including the Internet, is increasing rapidly, as is the provision of multimedia services capable of accommodating various types of information, such as text, images and music. Multimedia signals, including speech and music signals, require a broad bandwidth at the time of transmission. Therefore, to transmit multimedia data, including text, images and audio, it is highly desirable that the data is compressed.

Compression of digital speech and audio signals is well known. Compression is generally required to efficiently transmit signals over a communications channel, or to store compressed signals on a digital media device, such as a solid-state memory device or computer hard disk.

A fundamental principle of data compression is the elimination of redundant data. Data can be compressed by eliminating redundant temporal information such as where a sound is repeated, predictable or perceptually redundant. This takes into account human insensitivity to high frequencies.

Generally, compression results in signal degradation, with higher compression rates resulting in greater degradation. A bit stream is called scalable when parts of the stream can be removed in a way that the resulting sub-stream forms another valid bit stream for some target decoder, and the sub-stream represents the source content with a reconstruction quality that is less than that of the complete original bit stream but is high when considering the lower quantity of remaining data. Bit streams that do not provide this property are referred to as single-layer bit streams. The usual modes of scalability are temporal, spatial, and quality scalability. Scalability allows the compressed signal to be adjusted for optimum performance over a band-limited channel.

Scalability can be implemented in such a way that multiple encoding layers, including a base layer and at least one enhancement layer, are provided, and respective layers are constructed to have different resolutions.

While many encoding schemes are generic, some encoding schemes incorporate models of the signal. In general, better signal compression is achieved when the model is representative of the signal being encoded. Thus, it is known to choose the encoding scheme based upon a classification of the signal type. For example, a voice signal may be modeled and encoded in a different way to a music signal. However, signal classification is generally a difficult problem.

An example of a compression (or "coding") technique that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yield the lowest distortion is then either transmitted or stored, and eventually used to reconstruct an estimate of the original input signal. CELP is a particular analysis-by-synthesis method that uses one or more codebooks that each essentially comprises sets of code-vectors that are retrieved from the codebook in response to a codebook index.

In modern CELP coders, there is a problem with maintaining high quality speech and audio reproduction at reasonably low data rates. This is especially true for music or other generic audio signals that do not fit the CELP speech model very well. In this case, the model mismatch can cause severely degraded audio quality that can be unacceptable to an end user of the equipment that employs such methods.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
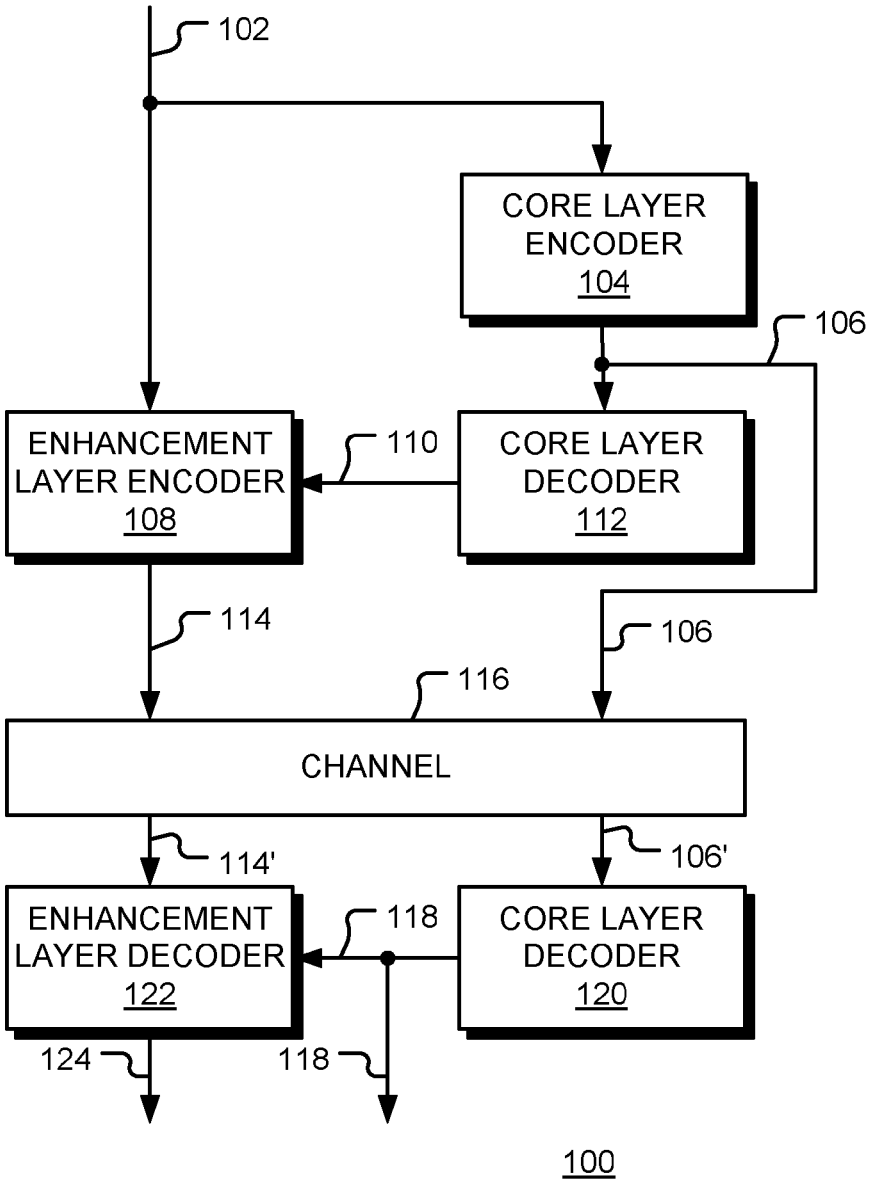
FIG. 1 Prior Art
FIG. 1 is a block diagram of a coding system and decoding system of the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to selective signal coding base on model fit. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

It will be appreciated that embodiments of the invention described herein may comprise one or more conventional processors and unique stored program instructions that control the one or more processors to implement, in conjunction with certain non-processor circuits, some, most, or all of the functions of selective signal coding base on model fit described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

FIG. 1 is a block diagram of an embedded coding and decoding system 100 of the prior art. In FIG. 1, an original signal s(n) 102 is input to a core layer encoder 104 of an encoding system. The core layer encoder 104 encodes the signal 102 and produces a core layer encoded signal 106. In addition, an original signal 102 is input to an enhancement layer encoder 108 of the encoding system. The enhancement layer encoder 108 also receives a first reconstructed signal $s_c(n)$ 110 as an input. The first reconstructed signal 110 is produced by passing the core layer encoded signal 106 through a first core layer decoder 112. The enhancement layer encoder 108 is used to code additional information based on some comparison of signals s(n) (102) and $s_c(n)$ (110), and may optionally use parameters from the core layer encoder 104. In one embodiment, the enhancement layer encoder 108 encodes an error signal that is the difference between the reconstructed signal 110 and the input signal 102. The enhancement layer encoder 108 produces an enhancement layer encoded signal 114. Both the core layer encoded signal 106 and the enhancement layer encoded signal 114 are passed to channel 116. The channel represents a medium, such as a communication channel and/or storage medium.

After passing through the channel, a second reconstructed signal 118 is produced by passing the received core layer encoded signal 106' through a second core layer decoder 120. The second core layer decoder 120 performs the same function as the first core layer decoder 112. If the enhancement layer encoded signal 114 is also passed through the channel 116 and received as signal 114', it may be passed to an enhancement layer decoder 122. The enhancement layer decoder 122 also receives the second reconstructed signal 118 as an input and produces a third reconstructed signal 124 as output. The third reconstructed signal 124 matches the original signal 102 more closely than does the second reconstructed signal 118.

The enhancement layer encoded signal 114 comprises additional information that enables the signal 102 to be reconstructed more accurately than second reconstructed signal 118. That is, it is an enhanced reconstruction.

One advantage of such an embedded coding system is that a particular channel 116 may not be capable of consistently supporting the bandwidth requirement associated with high quality audio coding algorithms. An embedded coder, however, allows a partial bit-stream to be received (e.g., only the core layer bit-stream) from the channel 116 to produce, for example, only the core output audio when the enhancement layer bit-stream is lost or corrupted. However, there are tradeoffs in quality between embedded vs. non-embedded coders, and also between different embedded coding optimization objectives. That is, higher quality enhancement layer coding can help achieve a better balance between core and enhancement layers, and also reduce overall data rate for better transmission characteristics (e.g., reduced congestion), which may result in lower packet error rates for the enhancement layers.

While many encoding schemes are generic, some encoding schemes incorporate models of the signal. In general, better signal compression is achieved when the model is representative of the signal being encoded. Thus, it is known to choose the encoding scheme based upon a classification of the signal type. For example, a voice signal may be modeled and encoded in a different way to a music signal. However, signal classification is a difficult problem in general.

Figure 2:
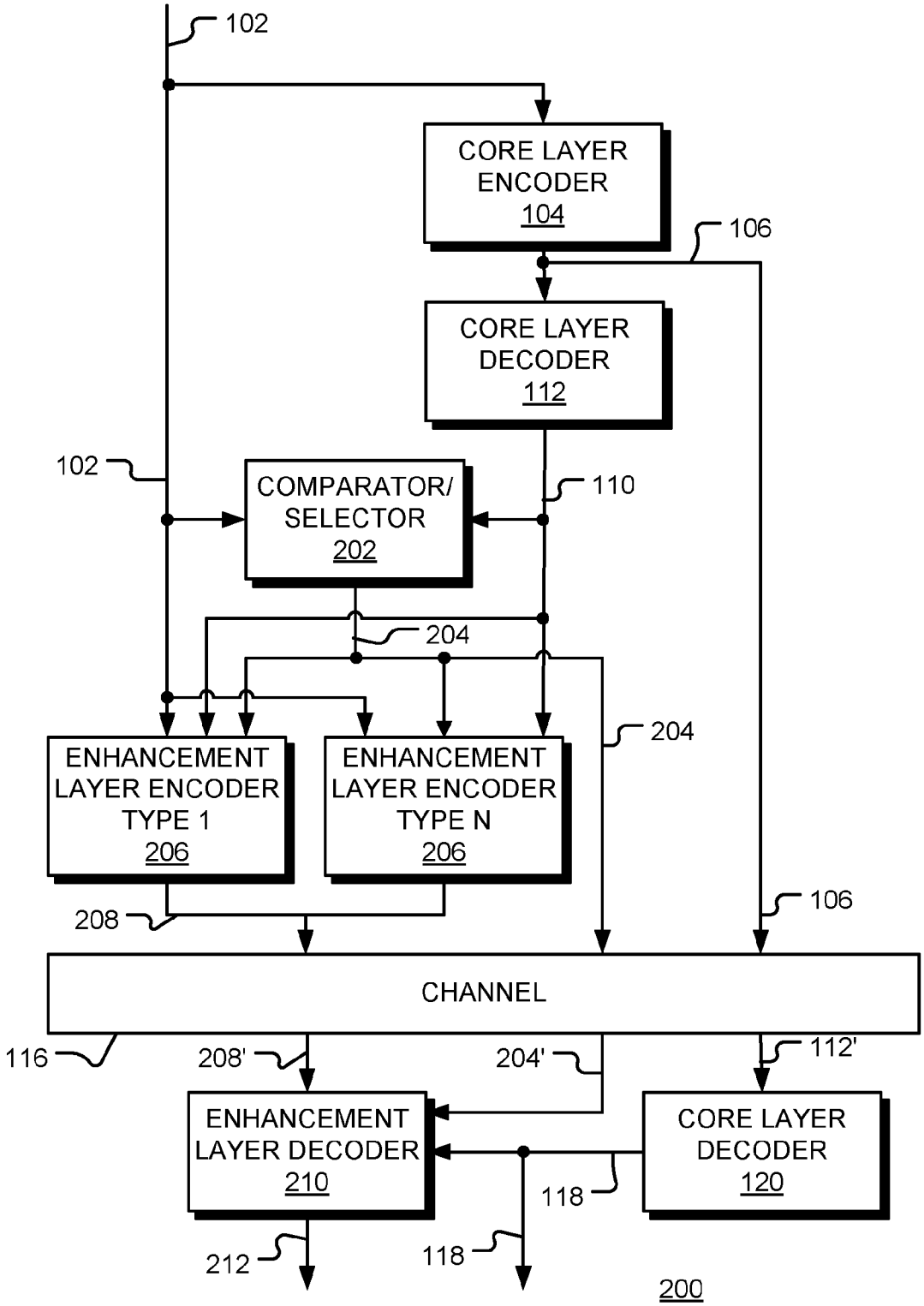
FIG. 2 is a block diagram of a coding system and decoding system in accordance with some embodiments of the invention.

FIG. 2 is a block diagram of a coding and decoding system 200 in accordance with some embodiments of the invention. Referring to FIG. 2, an original signal 102 is input to a core layer encoder 104 of an encoding system. The original signal 102 may be a speech/audio signal or other kind of signal. The core layer encoder 104 encodes the signal 102 and produces a core layer encoded signal 106. A first reconstructed signal 110 is produced by passing the core layer encoded signal 106 through a first core layer decoder 112. The original signal 102 and the first reconstructed signal 110 are compared in a comparator/selector module 202. The comparator/selector module 202 compares the original signal 102 with the first reconstructed signal 110 and, based on the comparison, produces a selection signal 204 which selects which one of the enhancement layer encoders 206 to use. Although only two enhancement layer encoders are shown in the figure, it should be recognized that multiple enhancement layer encoders may be used. The comparator/selector module 202 may select the enhancement layer encoder most likely to generate the best reconstructed signal.

Although core layer decoder 112 is shown to receive core layer encoded signal 106 that is correspondingly sent to channel 116, the physical connection between elements 104 and 106 may allow a more efficient implementation such that common processing elements and/or states could be shared and thus, would not require regeneration or duplication.

Each enhancement layer encoder 206 receives the original signal 102 and the first reconstructed signal as inputs (or a signal, such as a difference signal, derived from these signals), and the selected encoder produces an enhancement layer encoded signal 208. In one embodiment, the enhancement layer encoder 206 encodes an error signal that is the difference between the reconstructed signal 110 and the input signal 102. The enhancement layer encoded signal 208 contains additional information based on a comparison of the signals s(n) (102) and $s_c(n)$ (110). Optionally, it may use parameters from the core layer decoder 104. The core layer encoded signal 106, the enhancement layer encoded signal 208 and the selection signal 204 are all passed to channel 116. The channel represents a medium, such as a communication channel and/or storage medium.

After passing through the channel, a second reconstructed signal 118 is produced by passing the received core layer encoded signal 106' through a second core layer decoder 120. The second core layer decoder 120 performs the same function as the first core layer decoder 112. If the enhancement layer encoded signal 208 is also passed through the channel 116 and received as signal 208', it may be passed to an enhancement layer decoder 210. The enhancement layer decoder 210 also receives the second reconstructed signal 118 and the received selection signal 204' as inputs and produces a third reconstructed signal 212 as output. The operation of the enhancement layer decoder 210 is dependent upon the received selection signal 204'. The third reconstructed signal 212 matches the original signal 102 more closely than does the second reconstructed signal 118.

The enhancement layer encoded signal 208 comprises additional information, so the third reconstructed signal 212 matches the signal 102 more accurately than does second reconstructed signal 118.

Figure 3:
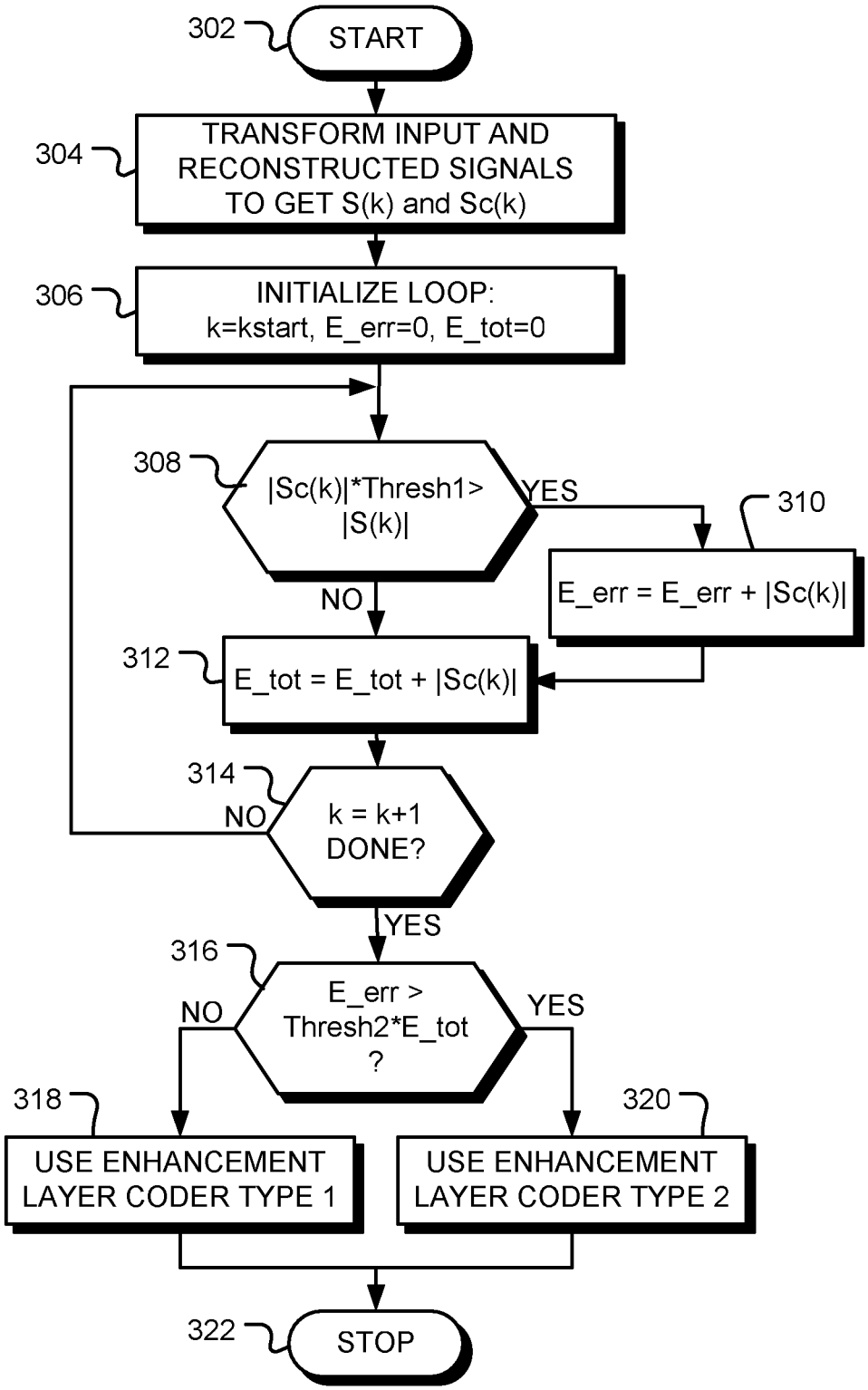
FIG. 3 is a flow chart of method for selecting a coding system in accordance with some embodiments of the invention.

FIG. 3 is a flow chart of method for selecting a coding system in accordance with some embodiments of the invention. In particular, FIG. 3 describes the operation of a comparator/selector module in an embodiment of the invention. Following start block 302, the input signal (102 in FIG. 2) and the reconstructed signal (110 in FIG. 2) are transformed, if desired, to a selected signal domain. The time domain signals may be used without transformation or, at block 304, the signals may be transformed to a spectral domain, such as the frequency domain, a modified discrete cosine transform (MDCT) domain, or a wavelet domain, for example, and may also be processed by other optional elements, such as perceptual weighting of certain frequency or temporal characteristics of the signals. The transformed (or time domain) input signal is denoted as S(k) for spectral component k, and the transformed (or time domain) reconstructed signal is denoted as $S_c(k)$ for spectral component k. For each component k in a selected set of components (which may be all or just some of the components), the energy, E_tot, in all components $S_c(k)$ of the reconstructed signal is compared with the energy, E_err, in those components which are larger (by some factor, for example) than the corresponding component S(k) of the original input signal.

While the input and reconstructed signal components may differ significantly in amplitude, a significant increase in amplitude of a reconstructed signal component is indicative of a poorly modeled input signal. As such, a lower amplitude reconstructed signal component may be compensated for by a given enhancement layer coding method, whereas, a higher amplitude (i.e., poorly modeled) reconstructed signal component may be better suited for an alternative enhancement layer coding method. One such alternative enhancement layer coding method may involve reducing the energy of certain components of the reconstructed signal prior to enhancement layer coding, such that the audible noise or distortion produced as a result of the core layer signal model mismatch is reduced.

Referring to FIG. 3 again, a loop of components is initialized at block 306, where the component k and is initialized and the energy measures E_tot and E_err are initialized to zero. At decision block 308, a check is made to determine if the absolute value of the component of the reconstructed signal is significantly larger than the corresponding component of the input signal. If it is significantly larger, as depicted by the positive branch from decision block 308, the component is added to the error energy E_err at block 310 and flow continues to block 312. At block 312, the component of the reconstructed signals is added to the total energy value, E_tot. At decision block 314, the component value is incremented and a check is made to determine if all components have been processed. If not, as depicted by the negative branch from decision block 314, flow returns to block 308. Otherwise, as depicted by the positive branch from decision block 316, the loop is completed and the total accumulated energies are compared at decision block 316. If the error energy E_err is much lower than the total error E_tot, as depicted by the negative branch from decision block 316, the type 1 enhancement layer is selected at block 318. Otherwise, as depicted by the positive branch from decision block 316, the type 2 enhancement layer is selected at block 320. The processing of this block of input signal is terminated at block 322.

It will be apparent to those of ordinary skill in the art that other measures of signal energy may be used, such as the absolute value of the component raised to some power. For example, the energy of a component $S_c(k)$ may be estimated as $|Sc(k)|^P$, and the energy of a component S(k) may be estimated as $|Sc(k)|^P$, where P is a number greater than zero.

It will be apparent to those of ordinary skill in the art that error energy E_err may be compared to the total energy in the input signal rather than the total energy in the reconstructed signal.

The encoder may be implemented on a programmed processor. An example code listing corresponding to FIG. 3 is given below. The variables energy_tot and energy_err are denoted by E_tot and E_err, respectively, in the figure.

```
Thresh1 = 0.49;
Thresh2 = 0.264;
energy_tot = 0;
energy_err = 0;
for (k = kStart; k <kMax; k++)
{
    if (Thresh1*abs(Sc[k]) > abs(S[k])) {
        energy_err += abs(Sc[k]);
    }
    energy_tot += abs(Sc[k]);
}
if (energy_err < Thresh2*energy_tot)
    type = 1;
    else
        type = 2;
```

In this example the threshold values Thresh1 and Thresh2 are set at 0.49 and 0.264, respectively. Other values may be used dependent upon the types of enhancement layer encoders being used and also dependent upon which transform domain is used.

A hysteresis stage may be added, so the enhancement layer type is only changed if a specified number of signal blocks are of the same type. For example, if encoder type 1 is being used, type 2 will not be selected unless two consecutive blocks indicate the use of type 2.

Figure 4:
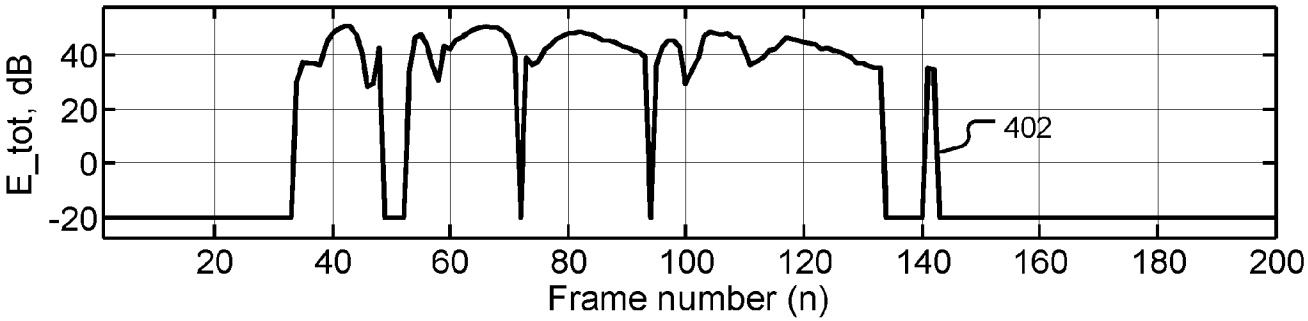
FIGS. 4-6 are a series of plots showing exemplary signals in a comparator/selector in accordance with some embodiments of the invention when a speech signal is input.
Figure 5:
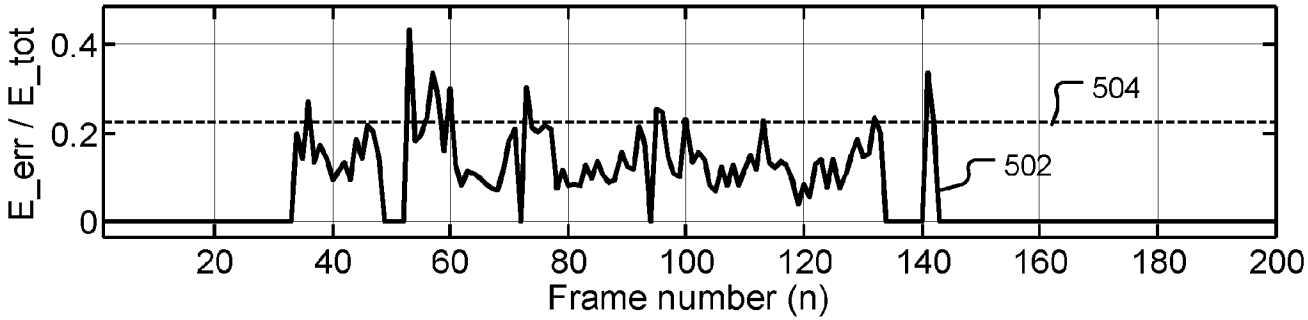
Figure 6:
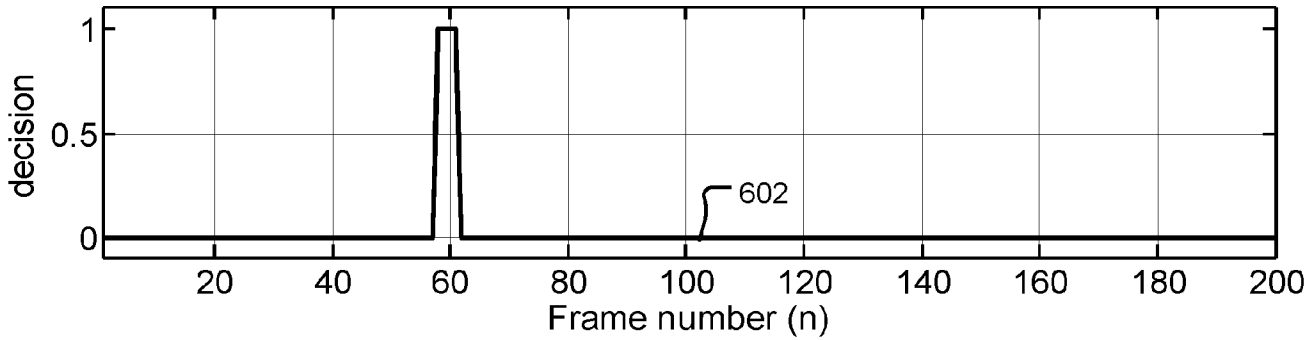

FIGS. 4-6 are a series of plots showing exemplary results for a speech signal. The plot 402 in FIG. 4 shows the energy E_tot of the reconstructed signal. The energy is calculated in 20 millisecond frames, so the plot shows the variation in signal energy over a 4 second interval. The plot 502 in FIG. 5 shows the ratio of the error energy E_err to the total energy E_tot over the same time period. The threshold value Thresh2 is shown as the broken line 504. The speech signal in frames where the ratio exceeds the threshold is not well modeled by the coder. However, for most frames the threshold is not exceeded. The plot 602 in FIG. 6 shows the selection or decision signal over the same time period. In this example, the value 0 indicates that the type 1 enhancement layer coder is selected and a value 1 indicates that the type 2 enhancement layer coder is selected. Isolated frames where the ratio is higher than the threshold are ignored and the selection is only changed when two consecutive frames indicate the same selection. Thus, for example, the type 1 enhancement layer encoder is selected for frame 141 even though the ratio exceeds the threshold.

Figure 7:
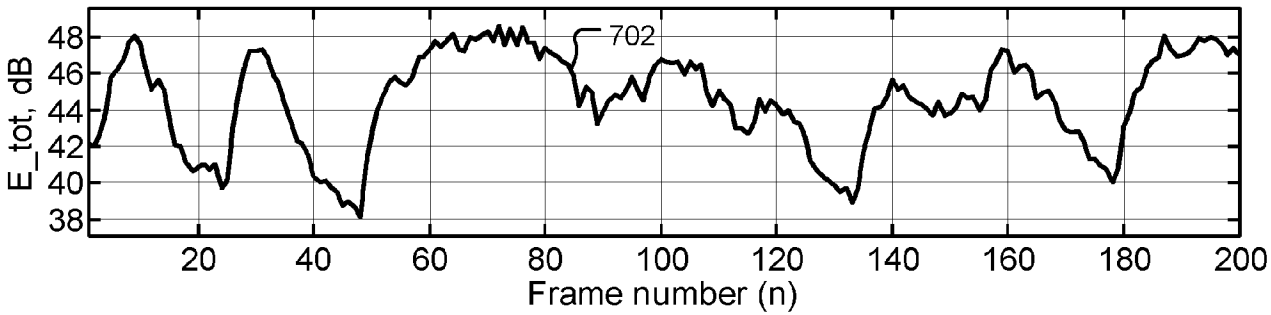
FIGS. 7-9 are a series of plots showing exemplary signals in a comparator/selector in accordance with some embodiments of the invention when a music signal is input.
Figure 8:
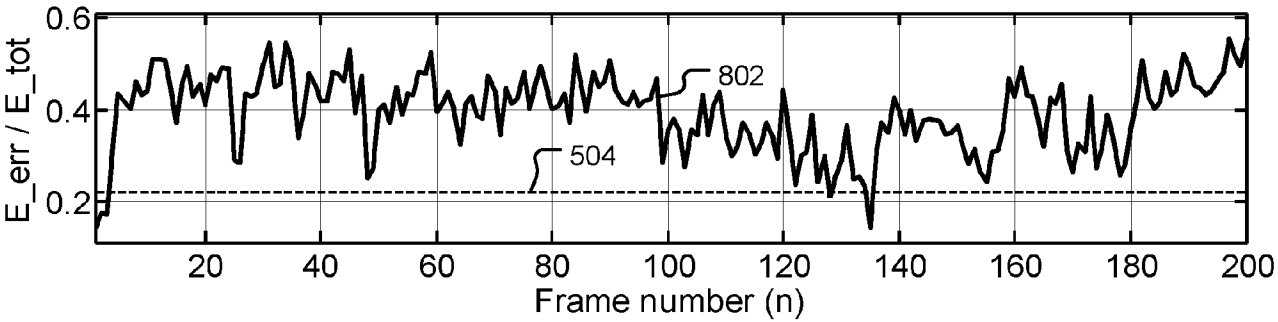
Figure 9:
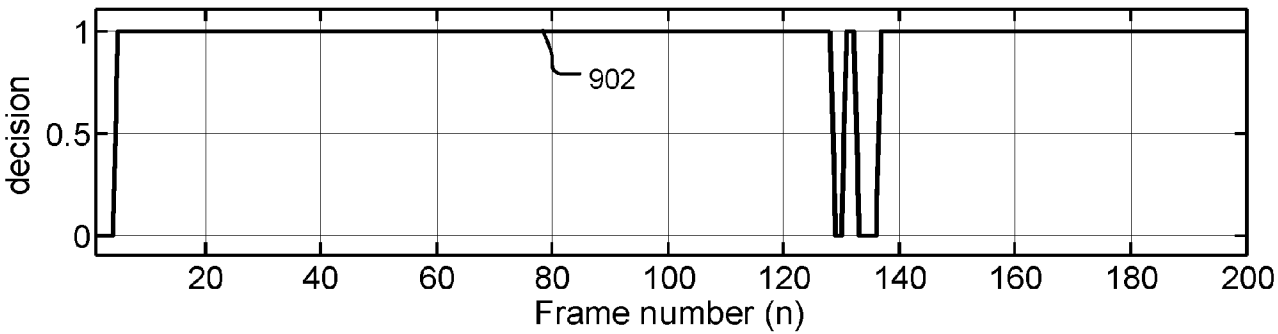

FIGS. 7-9 show a corresponding series of plots a music signal. The plot 702 in FIG. 7 shows the energy E_tot of the input signal. Again, the energy is calculated in 20 millisecond frames, so the plot shows the variation in input energy over a 4 second interval. The plot 802 in FIG. 8 shows ratio of the error energy E_err to the total energy E_tot over the same time period. The threshold value Thresh2 is shown as the broken line 504. The music signal in frames where the ratio exceeds the threshold is not well modeled by the coder. This is the case most frames, since the core coder is designed for speech signals. The plot 902 in FIG. 9 shows the selection or decision signal over the same time period. Again, the value 0 indicates that the type 1 enhancement layer encoder is selected and a value 1 indicates that the type 2 enhancement layer encoder is selected. Thus, the type 2 enhancement layer encoder is selected most of the time. However, in the frames where the core encoder happens to work well for the music, the type 1 enhancement layer encoder is selected.

In a test over 22,803 frames of a speech signal, the type 2 enhancement layer encoder was selected in only 227 frames, that is, only 1% of the time. In a test over 29,644 frames of music, the type 2 enhancement layer encoder was selected in 16,145 frames, that is, 54% of the time. In the other frames the core encoder happens to work well for the music and the enhancement layer encoder for speech was selected. Thus, the comparator/selector is not a speech/music classifier. This is in contrast to prior schemes that seek to classify the input signal as speech or music and then select the coding scheme accordingly. The approach here is to select the enhancement layer encoder dependent upon the performance of the core layer encoder.

Figure 10:
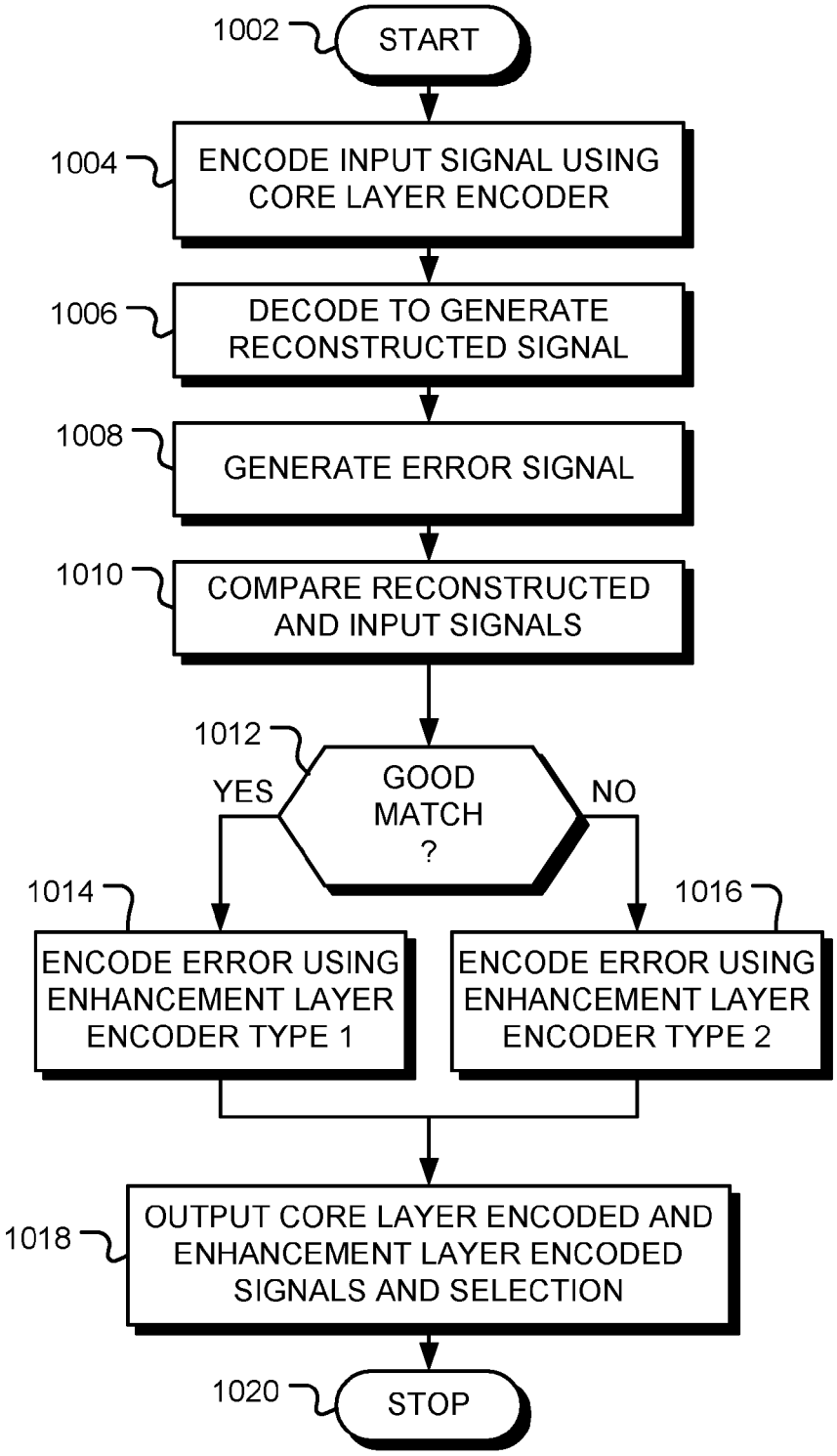
FIG. 10 is a flow chart of a method for selective signal encoding in accordance with some embodiments of the invention.

FIG. 10 is a flow chart showing operation of an embedded coder in accordance with some embodiments of the invention. The flow chart shows a method used to encode one frame of signal data. The length of the frame is selected based on a temporal characteristic of the signal. For example, a 20 ms frame may be used for speech signals. Following start block 1002 in FIG. 10, the input signal is encoded at block 1004 using a core layer encoder to produce a core layer encoded signal. At block 1006 the core layer encoded signal is decoded to produce a reconstructed signal. In this embodiment, an error signal is generated, at block 1008, as the difference between the reconstructed signal and the input signal. The reconstructed signal is compared to the input signal at block 1010 and at decision block 1012 it is determined if the reconstructed signal is a good match for the input signal. If the match is good, as depicted by the positive branch from decision block 1012, the type 1 enhancement layer encoder is used to encode the error signal at block 1014. If the match is not good, as depicted by the negative branch from decision block 1012, the type 2 enhancement layer encoder is used to encode the error signal at block 1016. At block 1018, the core layer encoded signal, the enhancement layer encoded signal and the selection indicator are output to the channel (for transmission or storage for example). Processing of the frame terminates at block 1020.

In this embodiment, the enhancement layer encoder is responsive to an error signal, however, in an alternative embodiment, the enhancement layer encoder is responsive the input signal and, optionally, one or more signals from the core layer encoder and/or the core layer decoder. In a still further embodiment, an alternative error signal is used, such as a weighted difference between the input signal and the reconstructed signal. For example, certain frequencies of the reconstructed signal may be attenuated prior to formation of the error signal. The resulting error signal may be referred to as a weighted error signal.

In another alternative embodiment, the core layer encoder and decoder may also include other enhancement layers, and the present invention comparator may receive as input the output of one of the previous enhancement layers as the reconstructed signal. Additionally, there may be subsequent enhancement layers to the aforementioned enhancement layers that may or may not be switched as a result of the comparison. For example, an embedded coding system may comprise five layers. The core layer (L1) and second layer (L2) may produce the reconstructed signal $S_c(k)$. The reconstructed signal $S_c(k)$ and input signal S(k) may then be used to select the enhancement layer encoding methods in layers three and four (L3, L4). Finally, layer five (L5) may comprise only a single enhancement layer encoding method.

The encoder may select between two or more enhancement layer encoders dependent upon the comparison between the reconstructed signal and the input signal.

The encoder and decoder may be implemented on a programmed processor, on a reconfigurable processor or on an application specific integrated circuit, for example.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A method for coding an input audio signal, the method comprising:

encoding the input signal using a core layer encoder to produce a core layer encoded signal;

decoding the core layer encoded signal to produce a reconstructed signal;

comparing the reconstructed signal to the input signal, wherein the comparing comprises estimating an energy E_err of the reconstructed signal that contain errors, determining a ratio S(k)/Sc(k) of component S(k) of the input signal to the component Sc(k) of the reconstructed signal exceeds a threshold value and summing the energies of those components Sc(k) of the reconstructed signal when the ratio S(k)/Sc(k) does not exceed the threshold value;

selecting an enhancement layer encoder from a plurality of enhancement layer encoders dependent upon the comparison between the reconstructed signal and the input signal; and generating an enhancement layer encoded signal using the selected enhancement layer encoder, the enhancement layer encoded signal being dependent upon the input signal.

2. A method in accordance with claim 1, further comprising:

generating an error signal as the difference between the reconstructed signal and the input signal, wherein generating the enhancement layer encoded signal comprises encoding the error signal.

3. A method in accordance with claim 2, wherein the error signal comprises a weighted difference between the reconstructed signal and the input signal.

4. A method in accordance with claim 1, wherein comparing the reconstructed signal to the input signal further comprises:

estimating an energy E_tot as a summation of energies in all components of the reconstructed signal;

and comparing the energy E_tot to the energy E_err.

5. A method in accordance with claim 4, further comprising:

transforming the reconstructed signal to produce the components of the reconstructed signal, wherein the transform is selected from the group of transforms consisting of a Fourier transform, a modified discrete cosine transform (MDCT) and a wavelet transform.

6. A method in accordance with claim 4, further comprising:

transforming the reconstructed signal to produce the components of the reconstructed signal; and transforming the input signal to produce the components of the input signal, wherein the transform is selected from the group of transforms consisting of a Fourier transform, a modified discrete cosine transform (MDCT) and a wavelet transform.

7. A method in accordance with claim 1, wherein the energy of a component Sc(k) is estimated as $|Sc(k)|^P$, and wherein the energy of a component S(k) is estimated as $|Sc(k)|^P$ where P is a number greater than zero.

8. A method in accordance with claim 4, wherein comparing the energy E_tot to the energy E_err comprises:

comparing the ratio of energies E_err/E_tot to a threshold value.

9. A method in accordance with claim 1, wherein the core layer encoded comprises a speech encoder.

10. A method in accordance with claim 1, further comprising outputting the core layer encoded signal, the enhancement layer encoded signal and an indicator of the selected enhancement layer encoder to a channel.

11. A selective signal encoder comprising a processor that includes instructions for executing functions of the encoder, the encoder comprising:

a core layer encoder that receives an input audio signal to be encoded and produces a core layer encoded signal;

a core layer decoder that receives the core layer encoded signal as input and produces a reconstructed signal;

a plurality of enhancement layer encoders each selectable to encode an error signal to produce an enhanced layer encoded signal, the error signal comprising a difference between the input signal and the reconstructed signal; and a comparator/selector module that selects an enhancement layer encoder of the plurality of enhancement layer encoders dependent upon a comparison of the input signal and core layer encoded signal, wherein the comparator/selector module estimates an energy E_err of the reconstructed signal that contains errors, determines a ratio S(k)/Sc(k) of component S(k) of the input signal to the component Sc(k) of the reconstructed signal exceeds a threshold value and sum the energies in components Sc(k) of the reconstructed signal when the ratio S(k)/Sc(k) does not exceed the threshold value, and further, wherein the input signal is encoded as the core layer encoded signal, the enhanced layer encoded signal and an indicator of the selected enhanced layer encoder.

12. A selective signal encoder in accordance with claim 11, wherein the core layer encoder comprises a speech encoder.

13. A selective signal encoder in accordance with claim 11, wherein the comparator/selector module further:

estimates an energy E_tot as a summation of energies in all components of the reconstructed signal;

and compares the energy E_tot to the energy E_err.

14. A selective signal encoder in accordance with claim 13, wherein the comparator/selector module compares the energy E_tot to the energy E_err by comparing the ratio of energies E_err/E_tot to a threshold value.

15. A selective signal encoder in accordance with claim 13, wherein the components of the reconstructed signal and the components of the input signal are computed via a transform selected from the group of transforms consisting of a Fourier transform, a modified discrete cosine transform (MDCT) and a wavelet transform.

* * * * *